US011674509B2

(12) United States Patent
Belshan et al.

(10) Patent No.: US 11,674,509 B2
(45) Date of Patent: Jun. 13, 2023

(54) LONG SLEEVE CARTRIDGE FOR A FLUID END BLOCK

(71) Applicant: SPM Oil & Gas Inc., Fort Worth, TX (US)

(72) Inventors: Daryl J. Belshan, Weatherford, TX (US); James Barnhouse, Spring, TX (US); Jacob Brown, Waller, TX (US); Todd R. Kabrich, Tomball, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 38 days.

(21) Appl. No.: 17/511,378

(22) Filed: Oct. 26, 2021

(65) Prior Publication Data

US 2023/0130824 A1 Apr. 27, 2023

(51) Int. Cl.
*F04B 53/16* (2006.01)
*F04B 53/02* (2006.01)

(52) U.S. Cl.
CPC ..... *F04B 53/02* (2013.01); *F04B 53/16* (2013.01)

(58) Field of Classification Search
CPC ..... F04B 53/16; F04B 53/02
See application file for complete search history.

(56) References Cited

U.S. PATENT DOCUMENTS 8,402,880 B2 3/2013 Patel et al.
9,739,130 B2 8/2017 Young
10,400,764 B2 9/2019 Wagner et al.
10,677,240 B2 6/2020 Graham et al.
2017/0218951 A1 8/2017 Graham et al.
2017/0227002 A1* 8/2017 Mikulski ..... F04B 53/1075
2019/0247957 A1 8/2019 Stribling et al.
2020/0362971 A1* 11/2020 Hurst ..... F04B 53/02

FOREIGN PATENT DOCUMENTS

CN 202633082 U 3/2013
CN 104534091 A 2/2017
CN 206320028 U 7/2017

* cited by examiner

*Primary Examiner* — Abiy Teka
*Assistant Examiner* — Daniel S Collins
(74) *Attorney, Agent, or Firm* — Bookoff McAndrews, PLLC

(57) ABSTRACT

A long sleeve cartridge for being inserted into a fluid end block of a pump is disclosed. The long sleeve cartridge includes a body and a sleeve bore extending through the body. The sleeve bore includes a first inner diameter and a second inner diameter. The first inner diameter is less than the second inner diameter. A first aperture is located on the body, and a second aperture is located on the body in a radial position substantially diametrically opposite of the first aperture. A packing seal assembly is secured within the long sleeve cartridge. The packing seal assembly includes one or more seals and a biasing mechanism to provide a compression force on the seals. The packing seal assembly is arranged within the second inner diameter when the packing seal assembly is disposed within the long sleeve cartridge.

20 Claims, 6 Drawing Sheets

LONG SLEEVE CARTRIDGE FOR A FLUID END BLOCK

TECHNICAL FIELD

The present disclosure relates generally to fluid end blocks of pumps, and more particularly, to a long sleeve cartridge for such fluid end blocks.

BACKGROUND

Well stimulation pumps, such as hydraulic fracturing pumps, are generally used in the oil and petroleum industry to assist in the removal of hydrocarbons from the earth. Generally, well stimulation pumps produce a pressurized fluid (e.g., more than 6000 pounds per square inch) that interacts with the earth to fracture or otherwise break apart rocks and other materials. The pumps usually include a plunger or piston that reciprocates within one or more bores of the pump in order to pressurize the fluid. A packing seal may be configured within the bores and around the plunger or piston in order to prevent fluids, such as the pressurized fluid and/or lubrication for the packing seal, from escaping around the plunger or piston or bore. Currently, the packing seal is inserted into the bores through a side of the fluid end block that is attached to a power end of the pump. A threaded cap or nut is then screwed into the bore in order to energize or otherwise provide a force onto the packing seal. Over time, the packing seal may wear or otherwise become damaged due to the fluid being pumped and the plunger or piston reciprocating within the packing seal. However, it may be difficult and time consuming for an operator or user to replace the worn or damaged packing seal due to the difficulty of accessing the packing seal via the side of the fluid end block that is attached to the power end of the pump.

One such fluid end is disclosed in U.S. Pat. No. 9,739,130 ("the '130 patent") to Young, issued on Aug. 22, 2017. The fluid end of the '130 patent includes a sleeve that is inserted into a plunger bore of the fluid end body. The sleeve of the '130 patent is disclosed as protecting the fluid end body from impingement by high pressure fracking fluid and to minimize the effects of erosion, corrosion, and fatigue of the internal surfaces of the fluid end body. Further, the fluid end block is heated and the sleeve is inserted therein, such that upon cooling, the fluid end block provides a tight, interference fit between the outer surfaces of the sleeve and the inner surfaces of the plunger bore of the fluid end block. However, the '130 patent may not provide for ease of removal of the sleeve for ease of replacement of a packing seal.

The disclosed long sleeve cartridge of the present disclosure may solve one or more of the problems set forth above and/or other problems in the art. The scope of the current disclosure, however, is defined by the attached claims, and not by the ability to solve any specific problem.

SUMMARY

In one aspect, a fluid end block for a pump is disclosed. The fluid end block may include: a first bore configured to receive fracking fluid from an inlet of the pump; a second bore configured to receive a reciprocating plunger, wherein the second bore includes a first portion having a first inner diameter and a second portion having a second inner diameter that is smaller than the first inner diameter such that a shoulder is defined between the first portion and the second portion; a third bore configured to receive a cover; a fourth bore configured to receive pressurized fluid, wherein the first bore and the fourth bore are substantially perpendicular to the second bore and the third bore; a long sleeve cartridge having a hollow interior, the long sleeve cartridge being disposed within the third bore and the second bore, the long sleeve cartridge configured to be removable from the fluid end block, wherein a proximal end of the long sleeve cartridge contacts the shoulder of the second bore; and a packing seal assembly disposed within the hollow interior of the long sleeve cartridge, the packing seal assembly having one or more seals In another aspect, a method of replacing a packing seal assembly of a fluid end block is disclosed. The fluid end block includes a first bore, a second bore including a first portion having a first inner diameter and a second portion having a second inner diameter that is smaller than the first inner diameter such that a shoulder is defined between the first portion and the second portion, a third bore, a fourth bore, wherein the first bore and the fourth bore are substantially perpendicular to the second bore and the third bore. The method comprises: removing a long sleeve cartridge from the fluid end block through the third bore, the long sleeve cartridge including a packing seal assembly having one or more seals; and inserting a new packing seal assembly through the third bore thereby disposing the new packing seal assembly within the second bore, wherein a proximal end of the long sleeve cartridge contacts the shoulder of the second bore.

In yet another aspect, a long sleeve cartridge for being inserted into a fluid end block of a pump is disclosed. The long sleeve cartridge includes: a body extending between a first end and a second end; a sleeve bore extending through the body from the first end to the second end such that the body defines a hollow interior having a first inner diameter and a second inner diameter, wherein the first inner diameter is less than the second inner diameter; a first aperture located on a first side of the body, and a second aperture located on the body in a radial position substantially diametrically opposite of the first aperture; and a packing seal assembly configured to be secured within the long sleeve cartridge, the packing seal assembly having one or more seals and a biasing mechanism configured to provide a compression force on the one or more seals, the packing seal assembly arranged within the second inner diameter of the hollow interior when the packing seal assembly is disposed within the long sleeve cartridge.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
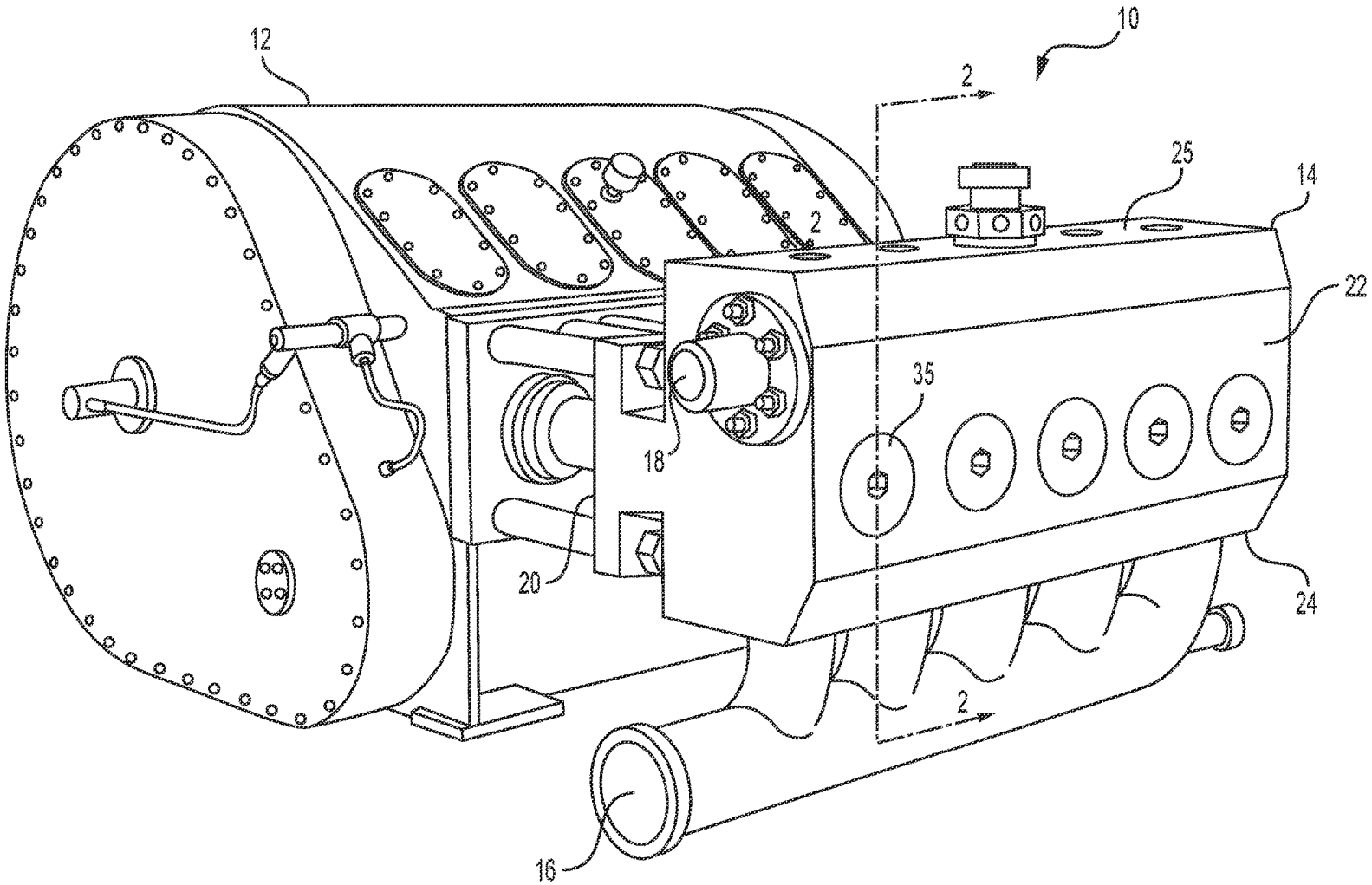
FIG. 1 is a perspective view of a pump having a fluid end block, according to one or more embodiments of the present disclosure.

Referring to FIG. 1, an exemplary pump 10 is disclosed. In the embodiment illustrated, the pump 10 is a well stimulation pump, such as a hydraulic fracturing pump. Pump 10 includes a power end 12, a pump body having a fluid end block 14, an inlet 16, and one or more outlets 18 (only a single outlet 18 is shown in FIG. 1). The power end 12 is coupled to the fluid end block 14. The power end 12 is driven by an external power source (not shown), which enables pump 10 to receive fluid, such as fracking fluid or the like, from a reservoir via inlet 16 into the fluid end block 14. As used herein, "fracking fluid" includes water that may include particulates (e.g., sand) and/or chemical additives.

Fluid end block 14 may be a generally rectangular elongated structure, as shown in FIG. 1 that includes a plurality of external surfaces. For example, fluid end block 14 includes a mounting surface 20 that may be used to secure fluid end block 14 to the power end 12 by a plurality of fastening mechanisms, such as bolts or the like. The fluid end block 14 further includes a first block surface 22 opposite the mounting surface 20, a second block surface 24, and a third block surface 25. Each of the second block surface 24 and the third block surface 25 may be generally perpendicular to the mounting surface 20 and the first block surface 22. The fluid end block 14 may be formed from a high strength steel (e.g., an alloy steel) or other suitable materials via forging, casting, additive manufacturing, or the like.

Figure 2:
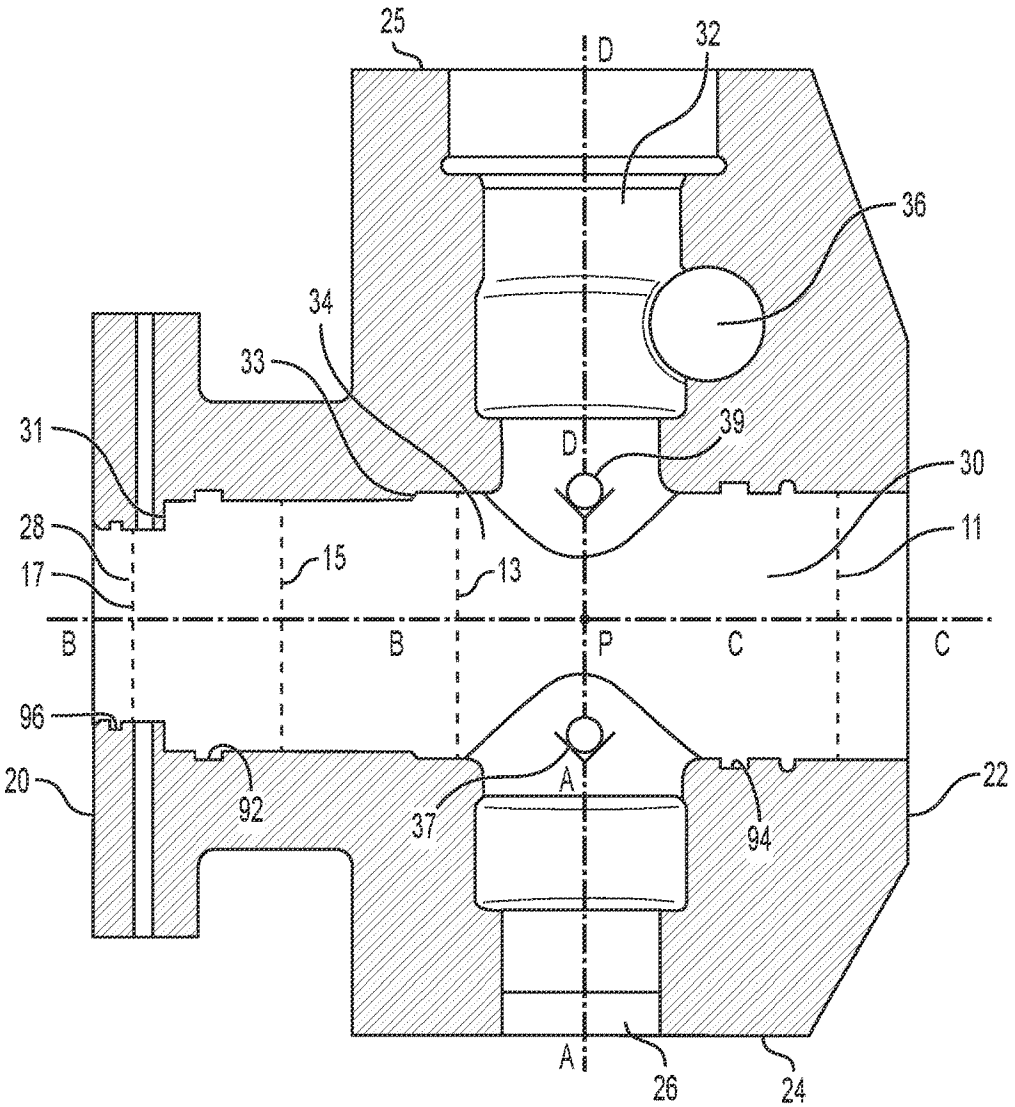
FIG. 2 is a cross-sectional view of the fluid end block of FIG. 1, along a plane passing through line 2-2.

FIG. 2 illustrates a cross-sectional view of the fluid end block 14 along a plane passing through line 2-2. As shown in FIG. 2, fluid end block 14 includes a first bore 26 having a first longitudinal axis A-A, a second bore 28 having a second longitudinal axis B-B, a third bore 30 having a third longitudinal axis C-C, and a fourth bore 32 having a fourth longitudinal axis D-D. Fluid end block 14 further includes a common volume chamber 34 that fluidly couples the bores (e.g., first bore 26, second bore 28, third bore 30, and fourth bore 32) with each other. First bore 26 may extend from the second block surface 24 to the common volume chamber 34. The second bore 28 may extend from the mounting surface 20 to the common volume chamber 34. The third bore 30 may extend from the first block surface 22 to the common volume chamber 34. The fourth bore 32 may extend from the third block surface 25 to the common volume chamber 34.

In the exemplary embodiment of FIG. 2, the first longitudinal axis A-A, the second longitudinal axis B-B, the third longitudinal axis C-C, and the fourth longitudinal axis D-D intersect at a common point P and are coplanar. The first longitudinal axis A-A may be substantially aligned with the fourth longitudinal axis D-D, and the second longitudinal axis B-B may be substantially aligned with third longitudinal axis C-C. Further, the first longitudinal axis A-A and the fourth longitudinal axis D-D may be substantially perpendicular to the second longitudinal axis B-B and the third longitudinal axis C-C.

Such a view of fluid end block 14 in FIG. 2 along a plane passing through line 2-2 (shown in FIG. 1) depicts only one set of first bore 26, second bore 28, third bore 30, and fourth bore 32. However, fluid end block 14 includes multiple sets of first bores 26, second bores 28, third bores 30, and fourth bores 32 (as is evident from the illustration of FIG. 1).

Figure 4A:
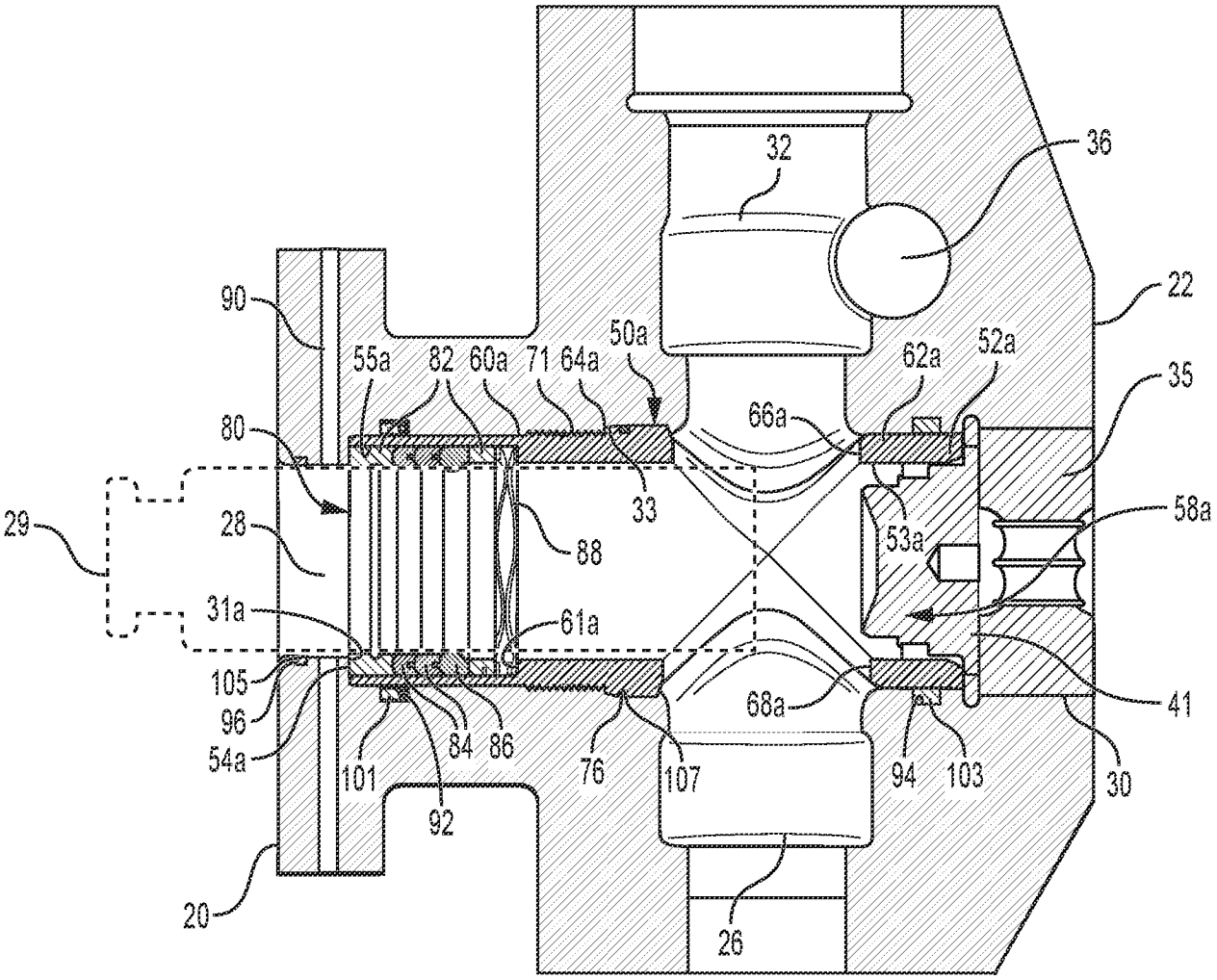
FIG. 4A is a cross-sectional view of the fluid end block of FIG. 1 with the long sleeve cartridge of FIG. 3A disposed therein.
Figure 4B:
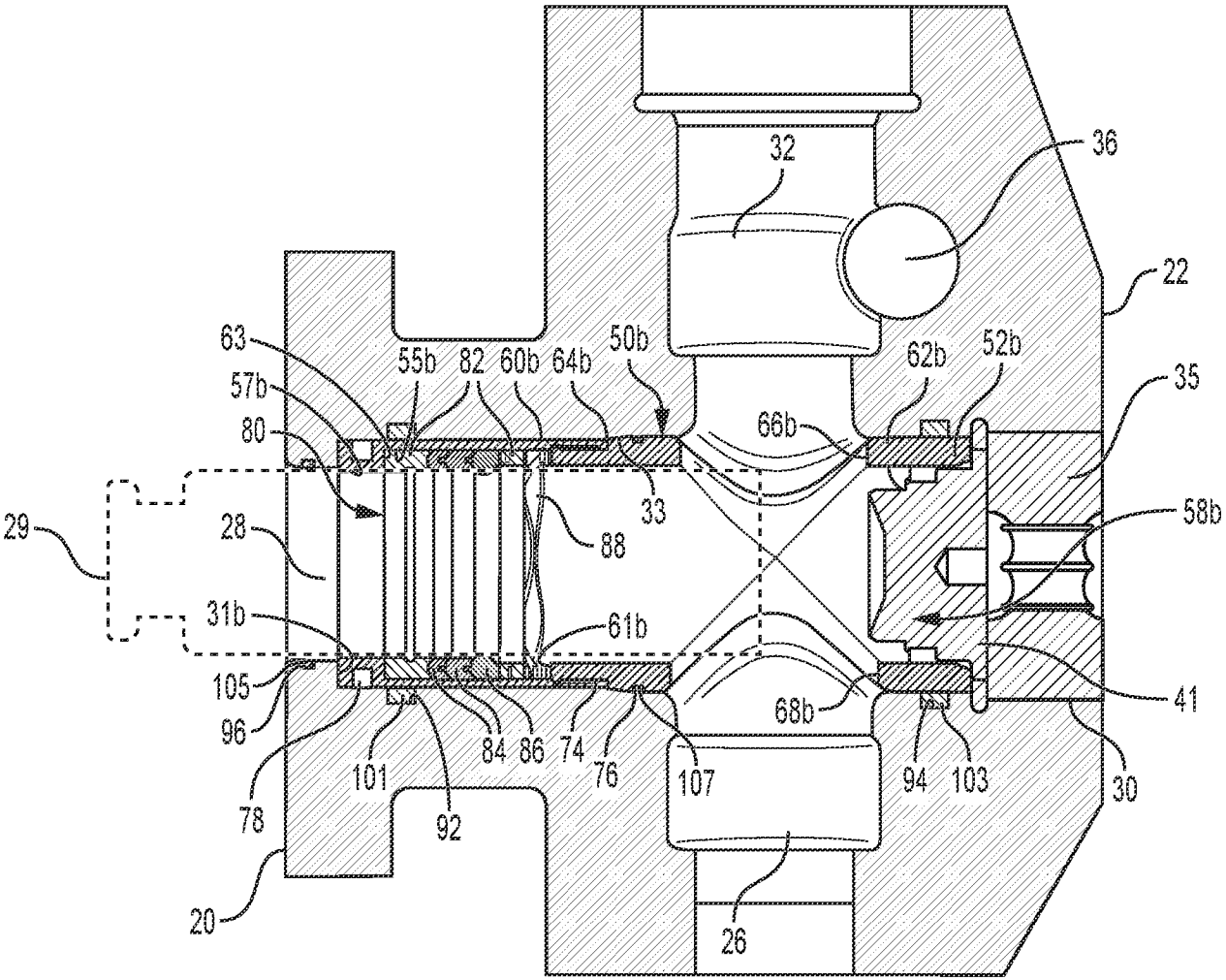
FIG. 4B is a cross-sectional view of the fluid end block of FIG. 1 with the long sleeve cartridge of FIG. 3B disposed therein.

Each bore, e.g., first bore 26, second bore 28, third bore 30, and fourth bore 32 in fluid end block 14 is configured to receive a component or a fluid or perform a certain function. For example, first bore 26 is configured to receive a fracking fluid from a reservoir via inlet 16. Second bore 28 is configured to receive a plunger 29 (shown schematically by dashed lines in FIGS. 4A and 4B), or piston, of the fluid end block 14. Third bore 30 is configured to receive a threaded cover 35 (as shown in FIG. 1 and FIGS. 4A and 4B). Fourth bore 32 is configured to discharge pressurized fracking fluid received from common volume chamber 34. Further, each fourth bore 32 is fluidly coupled to a common internal high pressure discharge passage 36 which serves as a passageway to transmit the pressurized fracking fluid from each fourth bore 32 to outlet 18. For example, discharge passage 36 may extend through a length of fluid end block 14 and each fourth bore 32 may be fluidly coupled to discharge passage 36. Each fourth bore 32 may be sealed so as to force fluid to exit to the discharge passage 36. The functionality of pump 10 is detailed further below. A first valve 37 (shown schematically in FIG. 2, and removed from FIGS. 4A and 4B for clarity), such as a one-way check valve or the like, may be situated in first bore 26 such that fracking fluid may ingress into common volume chamber 34 through the first valve and first valve may prevent the fracking fluid from receding back through first bore 26 towards the inlet 16. Similarly, a second valve 39 (shown schematically in FIG. 2, and removed from FIGS. 4A and 4B for clarity), such as a one-way check valve or the like, may be situated in fourth bore 32 such that pressurized fracking fluid may be forced through the second valve into fourth bore 32 and out discharge passage 36 towards outlet 18.

The first bore 26, second bore 28, third bore 30, and fourth bore 32 may each define an inner or interior surface of fluid end block 14. Each bore (e.g., the first bore 26, second bore 28, third bore 30, and fourth bore 32) may include one or more diameters. The one or more diameters of each bore may be defined as a measurement of the distance of a straight line from one point on the inner surface of the respective bore, through the center of the bore, to an opposite point on the inner surface of the bore. Each bore (e.g., first bore 26, second bore 28, third bore 30, and fourth bore 32) may include diameters of different sizes.

As shown in FIG. 2, third bore 30 includes a diameter 11, common volume chamber 34 includes a diameter 13, and second bore 28 includes a first diameter 15 and a second diameter 17. The diameter 11 of third bore 30 may be substantially equal or similar to the diameter 13 of common volume chamber 34. The first diameter 15 of second bore 28 is defined within a first portion of second bore 28 and the second diameter 17 of second bore 28 is defined within a second portion of second bore 28. The second diameter 17 may be smaller than the first diameter 15 such that a step, or shoulder 31, is defined between the first portion and the second portion of second bore 28. The first portion of second bore 28 may extend from common volume chamber 34 to shoulder 31, and the second portion of second bore 28 may extend from the shoulder 31 to mounting surface 20. The length of the first portion of second bore 28 may vary, as necessary, such that shoulder 31 may be located axially at different positions, as indicated by 31*a*, 31*b* in FIGS. 4A and 4B, respectively. The first diameter 15 of second bore 28 may be smaller than the diameter 11 of the common volume chamber 34. Thus, a step, or shoulder 33 may be defined between common volume chamber 34 and second bore 28. As further shown in FIG. 2, it is contemplated that first bore 26 and fourth bore 32 may include different portions having various diameters. Second bore 28 and third bore 30 may be configured to receive a long sleeve cartridge 50*a*, 50*b*, as detailed further below. Fluid end block 14 includes one or more seal grooves (e.g., seal grooves 92, 94, 96) for receiving respective seals therein, as detailed further below.

Figure 3A:
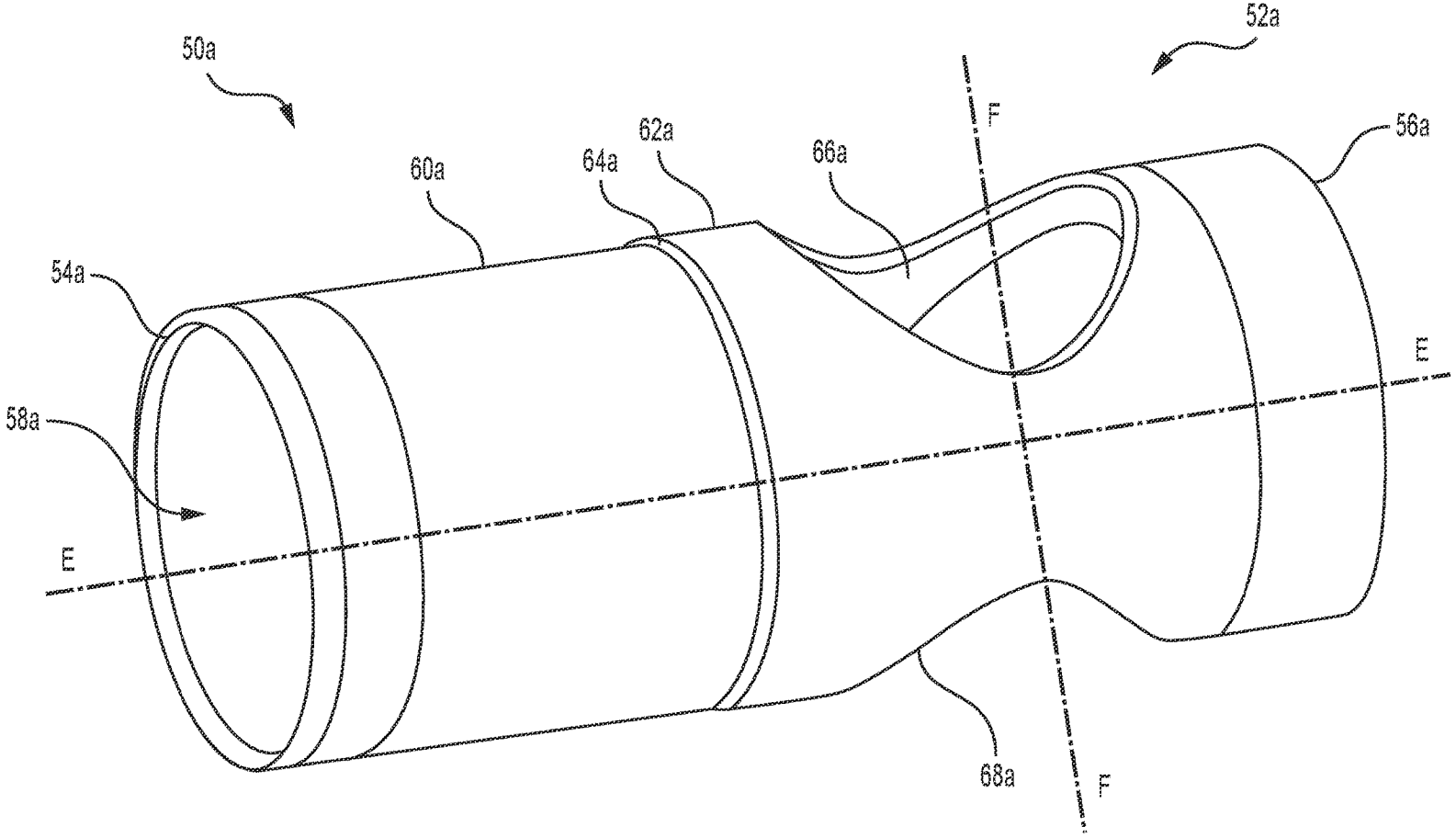
FIG. 3A is a perspective view of a long sleeve cartridge for the pump of FIG. 1, according a first embodiment.
Figure 3B:
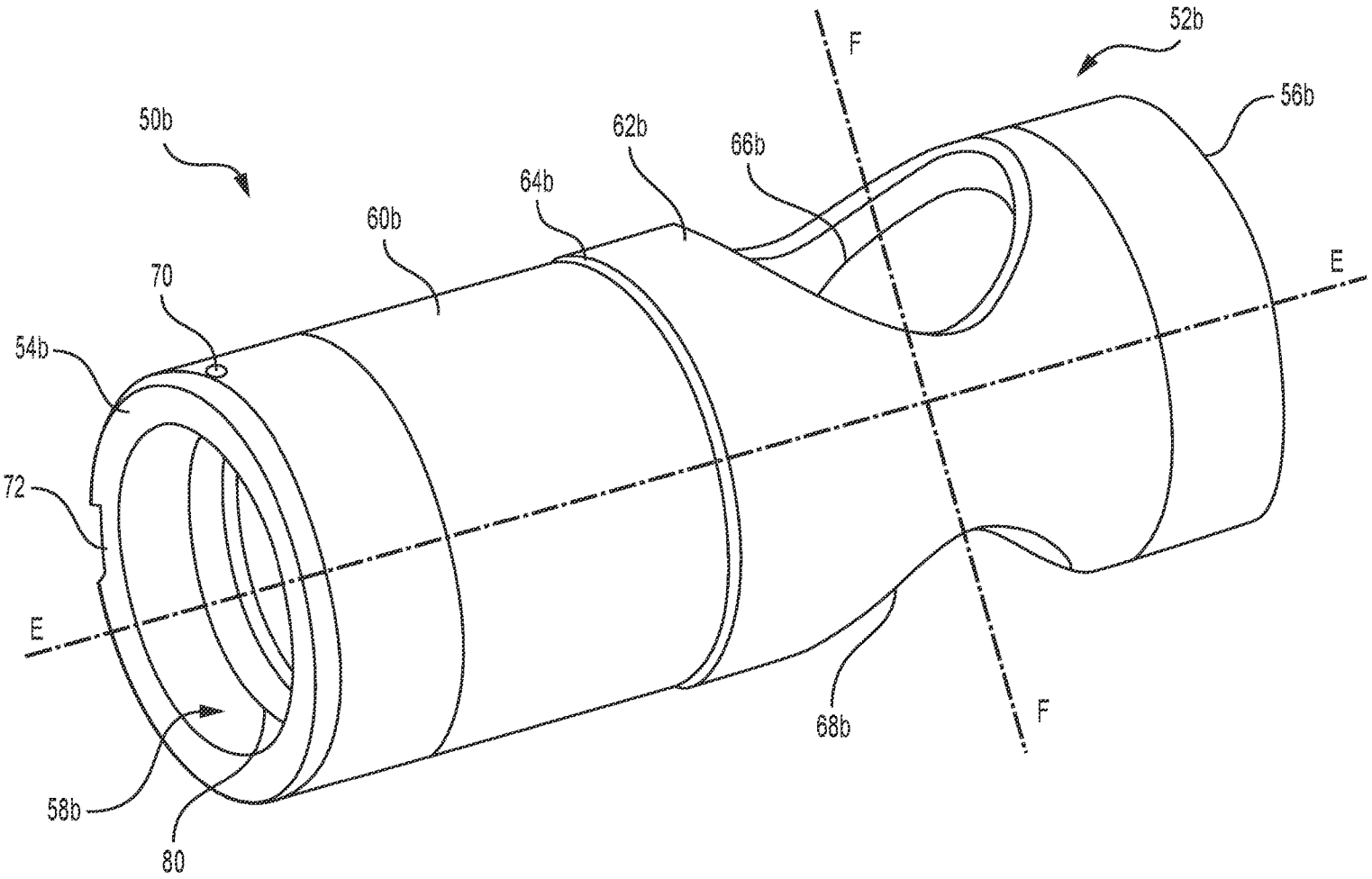
FIG. 3B is a perspective view of a long sleeve cartridge for the pump of FIG. 1, according to a second embodiment.

FIG. 3A illustrates a long sleeve cartridge 50*a* for pump 10, according a first embodiment. FIG. 3B illustrates a long sleeve cartridge 50*b* for pump 10, according to a second embodiment. As shown in FIGS. 3A and 3B, long sleeve cartridge 50*a*, 50*b* includes a body 52*a*, 52*b* having an outer surface extending between a proximal, first end 54*a*, 54*b* and a distal, second end 56*a*, 56*b*. Body 52*a*, 52*b* may include a generally cylindrical shape that includes one or more outer diameters of long sleeve cartridge 50*a*, 50*b* and a length from first end 54*a*, 54*b* to second end 56*a*, 56*b*. As used herein, an "outer diameter" of the body 52*a*, 52*b* is a measurement of the distance of a straight line from one point on the outer surface of the body 52*a*, 52*b*, through the center of the body 52*a*, 52*b*, to an opposite point on the outer surface of the body 52*a*, 52*b*. The one or more outer diameters of long sleeve cartridge 50*a*, 50*b* may correspond to the first diameter 15 of second bore 28 and the diameter 11 of third bore 30, respectively, such that long sleeve cartridge 50*a*, 50*b* may fit into second bore 28 and third bore 30, as detailed further below. The one or more outer diameters of long sleeve cartridge 50*a*, 50*b* may be in a range of 4-8 inches. The length of long sleeve cartridge 50*a*, 50*b* may be in a range of 10-25 inches. However, it is contemplated that long sleeve cartridge 50*a*, 50*b* may have any size and/or shape that corresponds to a size and/or shape of second bore 28 and third bore 30. Long sleeve cartridge 50*b* of FIG. 3B may be longer than long sleeve cartridge 50*a* of FIG. 3A (as shown in FIGS. 4A and 4B). Long sleeve cartridge 50*a*, 50*b* may be formed from a high strength steel (e.g., an alloy steel), and/or other metals and alloys exhibiting suitable corrosion and erosion resistance and strength, via forging, casting, additive manufacturing, or the like. In some examples, coatings and surface treatments may be applied to the surfaces of the long sleeve cartridge 50*a*, 50*b* to improve the corrosion and erosion characteristics thereof.

Body 52*a*, 52*b* includes an external surface that defines the one or more outer diameters of long sleeve cartridge 50*a*, 50*b* and a hollow interior that defines a sleeve bore 58*a*, 58*b*. Body 52*a*, 52*b* may include a first section 60*a*, 60*b* and a second section 62*a*, 62*b*. First section 60*a*, 60*b* may include a first outer diameter of body 52*a*, 52*b*, and second section 62*a*, 62*b* may include a second outer diameter of body 52*a*, 52*b*. The first outer diameter may be different than the second outer diameter. For example, the first outer diameter may be less than the second outer diameter such that first section 60*a*, 60*b* is smaller in diameter than second section 62*a*, 62*b*. Accordingly, a step, or shoulder 64*a*, 64*b* may define a transition between first section 60*a*, 60*b* and second section 62*a*, 62*b*. The shoulder 64*a*, 64*b* may define an external surface feature of body 52*a*, 52*b* and may include an increasing outer diameter from the first section 60*a*, 60*b* to the second section 62*a*, 62*b*. First section 60*a*, 60*b* may extend from first end 54*a*, 54*b* of body 52*a*, 52*b* to the shoulder 64*a*, 64*b*. Second section 62*a*, 62*b* may extend from the shoulder 64*a*, 64*b* to the second end 56*a*, 56*b* of body 52*a*, 52*b*. In FIG. 3A, body 52*a* is formed from a single piece such that first section 60*a* and second section 62*a* are part of the same, integral structure. In FIG. 3B, body 52*b* is formed of two or more separate pieces. For example, first section 60*b* may define a first piece and second section 62*b* may define a second piece. First section 60*b* may be received by, and coupled to, second section 62*b* by, for example, a threaded connection 74 (as shown in FIG. 4B), or the like. It is contemplated that first section 60*b* may be coupled to second section 62*b* by other suitable types of couplings or connections. It is contemplated that long sleeve cartridge 50*a*, 50*b* may include more than two separate pieces coupled together.

Sleeve bore 58*a*, 58*b* may be defined through body 52*a*, 52*b* along a longitudinal axis E-E and may define an inner surface of body 52*a*, 52*b*. Sleeve bore 58*a*, 58*b* may include one or more inner diameters, as detailed further below. As used herein, an "inner diameter" of the sleeve more 58*a*, 58*b* is a measurement of the distance of a straight line from one point on the inner surface of the body 52*a*, 52*b*, through the center of the body 52*a*, 52*b*, to an opposite point on the inner surface of the body 52*a*, 52*b*. Sleeve bore 58*a*, 58*b* may be configured to receive a packing seal assembly 80, as detailed further below with respect to FIGS. 4A and 4B.

Referring to FIGS. 3A and 3B, body 52*a*, 52*b* of long sleeve cartridge 50*a*, 50*b* may also define a first aperture 66*a*, 66*b* and a second aperture 68*a*, 68*b*. The first aperture 66*a*, 66*b* and the second aperture 68*a*, 68*b* may be located on the second section 62*a*, 62*b* of body 52*a*, 52*b*. First aperture 66*a*, 66*b* may be substantially diametrically opposite the second aperture 68*a*, 68*b* on body 52*a*, 52*b*. For example, the first aperture 66*a*, 66*b* may be located on a first side of the body 52*a*, 52*b* and the second aperture 68*a*, 68*b* may be located on the body 52*a*, 52*b* in a radial position substantially diametrically opposite of the first aperture 66*a*, 66*b*. Further, the first aperture 66*a*, 66*b* and the second aperture 68*a*, 68*b* may have the same longitudinal axis F-F (e.g., the axis F-F that passes through the center of both the first aperture 66*a*, 66*b* and the second aperture 68*a*, 68*b*, as shown in FIGS. 3A-3B). The first aperture 66*a*, 66*b* may be shaped and sized to correspond to fourth bore 32 and the second aperture 68*a*, 68*b* may be shaped and sized to correspond to first bore 26 (as shown in FIGS. 4A-4B). Accordingly, the first aperture 66*a*, 66*b* and the second aperture 68*a*, 68*b* may be aligned with the fourth bore 32 and the first bore 26, respectively, when long sleeve cartridge 50*a*, 50*b* is disposed within fluid end block 14, as detailed further below.

In the example of FIG. 3B, long sleeve cartridge 50*b* may include a hole 70 and an orientation mechanism 72. Hole 70 may be used for disassembly of the first section 60*b* from the second section 62*b* of body 52*b*. For example, a rod having a corresponding size to hole 70 may be inserted into hole 70 and a torque may be applied to the rod to disassemble the first section 60*b* from the second section 62*b*. The orientation mechanism 72 may include a notch or the like and may be used to circumferentially or rotationally orient long sleeve cartridge 50*b* within fluid end block 14 such that the first aperture 66*b* and the second aperture 68*b* align with fourth bore 32 and first bore 26, respectively, as detailed further below. Although not shown, it is contemplated that long sleeve cartridge 50*a* of FIG. 3A may similarly include an orientation mechanism 72 for orienting long sleeve cartridge 50*a* within fluid end block 14.

Long sleeve cartridge 50*a*, 50*b* may also be configured to receive and secure a packing seal assembly 80 (as shown in FIGS. 3B and 4A-4B), as detailed further below.

FIG. 4A is a cross-sectional view of the fluid end block 14 with the long sleeve cartridge 50*a* disposed therein. FIG. 4B is a cross-sectional view of the fluid end block 14 with the long sleeve cartridge 50*b* disposed therein. As shown in FIGS. 4A and 4B, long sleeve cartridge 50*a*, 50*b* may be disposed within fluid end block 14 such that long sleeve cartridge 50*a*, 50*b* extends from a portion of third bore 30, through common volume chamber 34, and to a portion of second bore 28. Long sleeve cartridge 50*b* may extend a greater length into second bore 28 compared to long sleeve cartridge 50*a*, as illustrated in FIGS. 4B and 4A, respectively.

Long sleeve cartridge 50*a*, 50*b* may be aligned within fluid end block 14 such that first aperture 66*a*, 66*b* is aligned with fourth bore 32, and second aperture 68*a*, 68*b* is aligned with first bore 26. In this way, sleeve bore 58*a*, 58*b* may receive plunger 29 from power end 12, and fracking fluid may be directed from first bore 26 through second aperture 68*a*, 68*b* into sleeve bore 58*a*, 58*b* and then through first aperture 66*a*, 66*b*, as detailed further below. The shoulder 31*b* of FIG. 4B may be located axially closer to mounting surface 20 as compared to the shoulder 31*a* of FIG. 4A, so as to accommodate the longer length of long sleeve cartridge 50*b*. The first end 54*a*, 54*b* of long sleeve cartridge 50*a*, 50*b* may abut, or otherwise contact, the shoulder 31*a*, 31*b* of fluid end block 14 such that long sleeve cartridge 50*a*, 50*b* is prevented from sliding, or otherwise moving, axially within second bore 28 beyond shoulder 31*a*, 31*b* and towards mounting surface 20. Accordingly, shoulder 31*a*, 31*b* may be operative to axially align long sleeve cartridge 50*a*, 50*b* such that first aperture 66*a*, 66*b* and second aperture 68*a*, 68*b* are coaxially aligned with fourth bore 32 and first bore 26, respectively.

Long sleeve cartridge 50*a*, 50*b* may be secured within, or coupled to, fluid end block 14 by one or more retaining mechanisms. For example, in FIG. 4A, the external surface of body 52*a* includes a threaded portion 71 threaded into a corresponding threaded portion of second bore 28. For example, an operator or user may use a tool to screw or otherwise couple the long sleeve cartridge 50*a*, 50*b* into the fluid end block 14. In some examples, the external surface of body 52*a* may be threaded into third bore 30. The threaded coupling can secure long sleeve cartridge 50*a* against dynamic and unbalanced loading during operation even without contact with threaded cap 35 at the distal end 56*a*, as described in detail below. In some examples, long sleeve cartridge 50*a*, 50*b* may also be configured to be retained or otherwise secured by threaded cover 35. For example, threaded cover 35 may abut or otherwise contact the second end 56*a*, 56*b* of long sleeve cartridge 50*a*, 50*b* and may include a retaining mechanism 41, such as an anti-rotation device, or the like, that inserted into and interacts with long sleeve cartridge 50*a*, 50*b* to secure long sleeve cartridge 50*a*, 50*b* in place. Thus, threaded cover 35 may prevent long sleeve cartridge 50*a*, 50*b* from sliding, or otherwise moving, axially within second bore 28 beyond threaded cover 35 and towards first block surface 22. Long sleeve cartridge 50*a*, 50*b* may also include one or more anti-rotation devices, such as orientation mechanism 72 that interact with corresponding orientation mechanisms of fluid end block 14 to lock long sleeve cartridge 50*a*, 50*b* in place within fluid end block 14. In this way, the retaining mechanisms may prevent long sleeve cartridge 50*a*, 50*b* from moving and/or rotating within fluid end block 14 when long sleeve cartridge 50*a*, 50*b* is disposed and mounted within fluid end block 14. It is contemplated that long sleeve cartridge 50*a*, 50*b* and/or fluid end block 14 may include any type and/or any number of retaining mechanisms for securing long sleeve cartridge 50*a*, 50*b* within fluid end block 14.

Long sleeve cartridge 50*a*, 50*b* may also include one or more annular seal grooves (e.g., annular seal groove 76) for receiving corresponding seals (e.g., seal 107). The seal 107 in seal groove 76 may seal long sleeve cartridge 50*a*, 50*b* from the fracking fluid. It is contemplated that the long sleeve cartridge 50*a*, 50*b* may include any desired number of seal grooves for receiving corresponding seals to improve sealing.

Long sleeve cartridge 50*a*, 50*b* is configured to receive packing seal assembly 80 within sleeve bore 58*a*, 58*b*. Sleeve bore 58*a*, 58*b* of long sleeve cartridge 50*a*, 50*b* may include a first section 53*a*, 53*b* and a second section 55*a*, 55*b*. First section 53*a*, 53*b* may include a first inner diameter of body 52*a*, 52*b*, and second section 55*a*, 55*b* may include a second inner diameter of body 52*a*, 52*b*. The first inner diameter may be different than the second inner diameter. For example, the first inner diameter may be smaller than the second inner diameter such that first section 53*a*, 53*b* is smaller in diameter than second section 55*a*, 55*b*. Accordingly, a step, or shoulder 61*a*, 61*b* may define a transition between first section 53*a*, 53*b* and second section 55*a*, 55*b*. The shoulder 61*a*, 61*b* may define an inner surface feature of body 52*a*, 52*b*. In FIG. 4B, sleeve bore 58*b* may include a third section 57*b* that includes a third inner diameter of body 52*b*. The third inner diameter may be substantially equal or similar to the first inner diameter, such that the third inner diameter is smaller than the second inner diameter. Accordingly, a step, or shoulder 63 may define a transition between second section 55*b* and third section 57*b*. The shoulder 63 may define an inner surface feature of body 52*a*, 52*b*. The shoulder 63 may be formed adjacent the proximal end 54*b* of the first section 60*b*, and the shoulder 61*b* may be formed adjacent a proximal end of the second section 62*b*.

First section 53*a*, 53*b* may extend from first end 54*a*, 54*b* of body 52*a*, 52*b* to the shoulder 61*a*, 61*b*. In FIG. 4A, second section 55*a* may extend from the shoulder 61*a* to the second end 56*a* of body 52*a*. In FIG. 4B, second section 55*b* may extend from the shoulder 61*b* to the shoulder 63. Third section 57*b* (shown in FIG. 4B) may extend from the shoulder 63 to the second end 56*b* of body 52*b*. The first inner diameter may be sized to receive a retaining mechanism, as detailed above. The second inner diameter may be sized to receive the packing seal assembly 80, as detailed further below. In FIG. 4B, the third inner diameter may be sized to receive plunger 29. Accordingly, the first inner diameter of body 52*a*, 52*b* may correspond to an outer diameter of the retaining mechanism and the second inner diameter of body 52*a*, 52*b* may correspond to an outer diameter of the packing seal assembly 80, and the third inner diameter may correspond to an outer diameter of plunger 29. The first and third inner diameters may be in a range of 3.5-7.5 inches and the second inner diameter may be in a range of 3.8-7.8 inches. It is contemplated that sleeve bore 58*a*, 58*b* may include any size and/or shape that corresponds to a size and/or shape of a retaining mechanism, the packing seal assembly 80, and/or the plunger 29, respectively.

As shown in FIGS. 4A and 4B, packing seal assembly 80 includes spacers 82, a seal stack of one or more annular seals (e.g., seals 84, 86), and a biasing mechanism (e.g., a spring 88, such as a wave spring). Spacers 82 include a pair of generally cylindrical annular rings configured to hold or otherwise secure the seals 84, 86 axially therebetween. In some examples, spacers 82 may include only a single annular ring that contacts the seal stack on one end (e.g., the distal or proximal end of the packing seal assembly 80 in relation to spring 88). In some example, the seals 84, 86 may include one or more first seals 84 and/or one or more second seals 86. In the example shown in FIGS. 4A and 4B, the seals 84, 86 include two first seals 84 and one second seal 86.

The spring 88 contacts one of the spaces 82 to provide a compression force to the seals 84, 86 via the spacers 82. In some examples, the spring 88 may directly contact the seal stack. In some examples, the spacers 82 and spring 88 may be coupled together (e.g., an integral piece). The spring 88 energizes the seals 84, 86 to provide sealing against the plunger 29. In some examples, in addition to or in place of the wave spring shown in FIGS. 4A-4B, spring 88 can be or include a stack of conical spring washers (i.e., Belleville washers) or another suitable biasing mechanism to pre-load the seals 84, 86. In other examples, the desired compression force on seals 84, 86 may be provided directly by long sleeve cartridge 50*a*, 50*b* without the use of spring 88. For example, the packing seal assembly 80 may be disposed within long sleeve cartridge 50*a*, 50*b* between two components to provide the compression force. In FIG. 4A, the packing seal assembly 80 may be disposed between, and abut, shoulder 61*a* of long sleeve cartridge 50*a* and shoulder 31*a* of fluid end block 14 such that an axial force is applied to the packing seal assembly 80. In FIG. 4B, the packing seal assembly 80 may be disposed between, and abut, shoulder 61*b* and shoulder 63 of long sleeve cartridge 50*b* such that an axial force is applied to the packing seal assembly 80. For example, the two pieces of long sleeve cartridge 50*b* may be coupled together such that the axial force is applied through the shoulders 61*b* and 63 onto the packing seal assembly 80. The axial force may thus provide the desired compression force on seals 84, 86. By providing a compression force to pre-load the seals 84, 86 in such a way, the fluid end block 14 and long sleeve cartridge 50*a*, 50*b* arrangement of the present disclosure eliminates the need for the threaded cap of conventional fluid ends to be inserted through second bore 28 to pre-load or energize the seals. Thus, fluid end block 14 does not include a threaded cap or nut in second bore 28, and packing seal assembly 80 may be accessed and replaced through third bore 30, as detailed further below.

In some examples, the spacers 82 may be formed from one or more metals or metal alloys. In some examples, the seals 84, 86 may be elastomeric (e.g., formed from nitrile butadiene rubber). It is contemplated that the spacers 82 and the seals 84, 86 may be formed of any desired material known in the art.

An outer surface of the spacers 82 and the seals 84, 86 may be sized and/or shaped to correspond to a size and/or shape of the second inner diameter of sleeve bore 58*a*, 58*b*. The spring 88 may also be sized to correspond to a size of the second inner diameter of sleeve bore 58*a*, 58*b*. As shown in FIG. 4A, the second section 55*a* of sleeve bore 58*a* extends to, or intersects with, the first end 54*a* such that the packing seal assembly 80 may be inserted into sleeve bore 58*a* from the first end 54*a*. The spacers 82 and the seals 84, 86 may each define an inner surface having an inner diameter. The inner diameter of the spacers 82 and seals 84, 86 may correspond to the outer diameter of plunger 29 such that the inner surface of spacers 82 and seals 84, 86 contacts an outer surface of plunger 29. The inner surface of the spacers 82 and the seals 84, 86 may be sized and/or shaped to correspond to a size and/or shape of plunger 29 such that in the energized state, the seals 84, 86 may slidingly and sealingly contact the plunger 29. Packing seal assembly 80 may be secured within long sleeve cartridge 50*a*, 50*b* by a tight fit with allowance for the seals 84, 86 to compress against the inner surface of second section 55*a*, 55*b* of sleeve bore 58*a*, 58*b* and against plunger 29 in the energized state. In the example of FIG. 4A, a first, proximal end of the packing seal assembly 80 may extend axially beyond the first end 54*a* of long sleeve cartridge 50*a* prior to long sleeve cartridge 50*a* being secured within fluid end block 14 (e.g., prior to spring 88 being compressed and providing the compression force on the seals 84, 86). When long sleeve cartridge 50*a* is disposed and secured within fluid end block 14, as detailed above, packing seal assembly 80 may be aligned substantially flush with the first end 54*a* of long sleeve cartridge 50*a*. For example, packing seal assembly 80 may contact shoulder 31*a* such that spring 88 is compressed against shoulder 61*a* of long sleeve cartridge 50*a*, until first end 54*a* of long sleeve cartridge 50*a* abuts or contacts shoulder 31. In some examples, the shoulders 31*a* and 61*a* may provide the compression on seals 84, 86 when the spring 88 is removed, as detailed above. Thus, the packing seal assembly 80 may be secured within fluid end block 14 between long sleeve cartridge 50*a* and shoulder 31*a* of fluid end block 14 and the compression provided by spring 88 and/or by shoulder 31*a* and shoulder 61*a* may energize seals 84, 86.

In the example of FIG. 4B, packing seal assembly 80 is secured within long sleeve cartridge 50*b* by being assembled between separate pieces of the long sleeve cartridge 50*b*. As shown, packing seal assembly 80 is disposed axially between shoulder 61*b* and shoulder 63, thereby preventing packing seal assembly 80 from sliding out of long sleeve cartridge 50*b* during operation of pump 10, as detailed further below. The force provided when long sleeve cartridge 50*b* abuts or contacts shoulder 31*b* may compress the spring 88 to energize the seals 84, 86. In some examples, the shoulders 61*b* and 63 may provide the compression directly on seals 84, 86 to energize seals 84, 86 when spring 88 is removed, as detailed above. The two-piece assembly of long sleeve cartridge 50*b* enables the packing seal assembly 80 to be pulled from fluid end block 14 together with long sleeve cartridge 50*b* during disassembly. Further, the longer length of long sleeve cartridge 50*b* enables the packing seal assembly 80 to be placed in a location within long sleeve cartridge 50*b* in relation to second bore 28 that is similar to that of long sleeve cartridge 50*a*. In the two-piece long sleeve cartridge 50*b*, at least a portion of the dynamic load applied on the packing seal assembly 80 by the pressurized fluid may be absorbed within the threads 74, such that minimal extra load is exerted on the fluid end block 14.

Fluid end block 14 may include one or more lubrication and sealing features. As shown in FIG. 4A, fluid end block 14 includes a lubrication bore 90 (removed from FIG. 4B for clarity) for providing lubrication to the packing seal assembly 80. Fluid end block 14 includes one or more seal grooves (e.g., seal grooves 92, 94, 96) for receiving respective annular seals (e.g., seals 101, 103, 105) therein. For example, a first seal groove 92 may receive a first seal 101 of fluid end block 14, a second seal groove 94 may receive a second seal 103 of fluid end block 14, and a third seal groove 96 may receive a third seal 105 of fluid end block. The first, second, and third seals may include O-rings, wiper rings, or the like. Seals received in the first seal groove 92 and the second seal groove 94 of fluid end block 14 are configured to seal with the external surface of the body 52*a*, 52*b* to prevent fluid from leaking between the external surface of long sleeve cartridge 50*a*, 50*b* and the interior of fluid end block 14. The seal 105 received in the the third seal groove 96 is configured to seal with plunger 29 to prevent loss of the packing lubrication through second bore 28 of the fluid end block 14. Only three seal grooves 92, 94, 96 and corresponding seals 101, 103, 105 are illustrated in FIGS. 4A and 4B. It is contemplated that the interior of fluid end block 14 may include any number and arrangement of seals to reduce or prevent fluid leaks.

INDUSTRIAL APPLICABILITY

The disclosed aspects of fluid end block 14 and long sleeve cartridge 50*a*, 50*b* may be employed in any fracking-type, or similar well stimulation pump 10. For example, fluid end block 14 may be manufactured such that bores 28, 30 are sized and configured to receive long sleeve cartridge 50*a*, 50*b*. In some examples, fluid end block 14 may be retrofitted and remanufactured to receive long sleeve cartridge 50*a*, 50*b*. For example, bores 28, 30, or a portion thereof, may be bored or otherwise machined to increase a diameter of bores 28, 30 to receive long sleeve cartridge 50*a*, 50*b*.

With reference to FIGS. 1, 2, 4A, and 4B, long sleeve cartridge 50*a*, 50*b* may be placed into fluid end block 14 prior to operation of pump 10. For example, an operator or other user may remove the threaded cover 35 of fluid end block 14 and insert long sleeve cartridge 50*a*, 50*b* through third bore 30. As detailed above, shoulder 31*a*, 31*b* may help to coaxially align first aperture 66*a*, 66*b* and second aperture 68*a*, 68*b* with fourth bore 32 and first bore 26, respectively. Shoulder 31*a*, 31*b* may also provide a force on long sleeve cartridge 50*a*, 50*b* to assist in energizing the seals 84, 86 of packing seal assembly 80, as detailed above. Long sleeve cartridge 50*a*, 50*b* may include an orientation mechanism 72 to help circumferentially or rotationally align and orient long sleeve cartridge 50*a*, 50*b* accordingly. Alignment and orientation of long sleeve cartridge 50*a*, 50*b* may align packing seal assembly 80 in a suitable location for sealing the plunger 29, as detailed above. Long sleeve cartridge 50*a*, 50*b* may then be secured in fluid end block 14 by the one or more retaining mechanisms (e.g., threaded portion 71), as discussed above. Thus, long sleeve cartridge 50*a*, 50*b* may extend from third bore 30 into second bore 28 when long sleeve cartridge 50*a*, 50*b* is disposed within fluid end block 14.

During operation, power end 12 of pump 10 may be driven by an external power source. The plunger 29 may reciprocate within sleeve bore 58*a*, 58*b* of long sleeve cartridge 50*a*, 50*b* at a location of long sleeve cartridge 50*a*, 50*b* in second bore 28. For example, the plunger 29 may be pulled back towards power end 12 during an intake stroke. The reciprocation action may allow fracking fluid from a reservoir into fluid end block 14 via inlet 16. The fracking fluid may be directed through first bore 26, through the first valve 37, and through second aperture 68*a*, 68*b*. Thus, the fracking fluid may enter into sleeve bore 58*a*, 58*b* at a location of long sleeve cartridge 50*a*, 50*b* that is aligned with common volume chamber 34. The power end 12 may then push the plunger 29 from the power end 12 in the direction of the common volume chamber 34 in a pumping stroke. The pumping stroke by the plunger 29 may pressurize the fracking fluid held in sleeve bore 58*a*, 58*b* at the common volume chamber 34. The pressurized fracking fluid may then be forced through first aperture 66*a*, 66*b* and through the second valve 39 and directed into fourth bore 32. The pressurized fracking fluid may then be directed through discharge passage 36 (e.g., being combined with pressurized fracking fluid from multiple fourth bores 32) and may exit fluid end block 14 through outlet 18 in order to provide a fracturing pressure to fracture rocks and/or other materials.

As the pump 10 operates, the seals 84, 86 of packing seal assembly 80 may wear and/or otherwise become damaged from the reciprocating motion of the plunger 29. As the seals 84, 86 wear and pump 10 continues to operate, spring 88 may maintain a force on the seals 84, 86 such that the seals 84, 86 adequately remain energized and provide sealing against plunger 29. For example, as the seals 84, 86 wear, spring 88 may expand and continue to compress the seals 84, 86, as detailed above. However, seals 84, 86 may wear beyond a threshold in which spring 88 may no longer provide adequate compression force on seals 84, 86 to energize the seals 84, 86. In such instances, the operator or user may stop operation of pump 10 and remove long sleeve cartridge 50*a*, 50*b* to replace packing seal assembly 80, or portions thereof. Thus, a method of replacing the packing seal assembly 80 is disclosed. The method may include removing long sleeve cartridge 50*a*, 50*b* from fluid end block 14 through third bore 30. For example, the operator or user may remove the threaded cover 35 from third bore 30. The operator or user may then uncouple long sleeve cartridge 50*a*, 50*b* and remove long sleeve cartridge 50*a*, 50*b* via third bore 30. Packing seal assembly 80 may be retained within long sleeve cartridge 50*a*, 50*b* during uncoupling and removal from fluid end block 14, as detailed above.

In some examples, the method may include replacing the packing seal assembly 80 with a new packing seal assembly 80 within the same long sleeve cartridge 50*a*, 50*b*. For example, the operator or user may replace the worn seals 84, 86 with new seals and/or replace the entire packing seal assembly 80 with a new packing seal assembly 80. In FIG. 4A, the packing seal assembly 80 may be inserted into sleeve bore 58*a* via the first end 54*a* of long sleeve cartridge 50*a*, and disposed within long sleeve cartridge 50*a* between the first end 54*a* and shoulder 61*a* such that a portion of packing seal assembly 80 extends axially beyond the first end 54*a*, as detailed above. In FIG. 4B, the operator or user may uncouple the two pieces (e.g., first section 60*b* and second section 62*b*) of long sleeve cartridge 50*b* to access the packing seal assembly 80 within long sleeve cartridge 50*b*, as detailed above. The user or operator may remove the packing seal assembly 80 from the long sleeve cartridge 50*b*.

The user or operator may then place or insert a new packing seal assembly 80 within the first section 60*b* and secure or otherwise couple the first section 60*b* to the second section 62*b* together, as detailed above. As used herein, a "new packing seal assembly 80" includes an entirely new packing seal assembly or new components thereof (e.g., spacers 82, seals 84, 86, and/or spring 88). Thus, in some examples, the long sleeve cartridge 50*a*, 50*b* may be reusable. In other words, the long sleeve cartridge 50*a*, 50*b*, including the packing seal assembly 80, may be replaced with the same long sleeve cartridge 50*a*, 50*b* with a new packing seal assembly 80 and then inserted through third bore 30, as detailed above. In other examples, a new long sleeve cartridge 50*a*, 50*b* having a new packing seal assembly 80 may be inserted through third bore 30, as detailed above. Thus, the method may include replacing the long sleeve cartridge 50*a*, 50*b* with a new long sleeve cartridge 50*a*,50*b* having the new packing seal assembly 80. The second diameter 17 of second bore 28 may prevent long sleeve cartridge 50*a*, 50*b* and/or packing seal assembly 80 from being inserted through the second bore 28 from the mounting surface 20. For example, the outer diameters of the long sleeve cartridge 50*a*, 50*b* and the packing seal assembly 80 may be larger than the second diameter 17 of second bore 28 such that the long sleeve cartridge 50*a*, 50*b* and packing seal assembly 80 is not able to be inserted through a portion of second bore 28 defined by the second diameter 17.

The long sleeve cartridge 50*a*, 50*b* may provide for an improved packing seal assembly 80 replacement mechanism. For example, the long sleeve cartridge 50*a*, 50*b* may provide for ease of access to the packing seal assembly 80 by enabling access through third bore 30. For example, third bore 30 may be sized to receive an entirety of long sleeve cartridge 50*a*, 50*b* and second bore 28 may be sized to receive only the first section 60*a*, 60*b* of long sleeve cartridge 50*a*, 50*b*, as detailed above. When long sleeve cartridge 50*a*, 50*b* is disposed within fluid end block 14, the shoulder 31*a*, 31*b* (e.g., provided by the various diameters of second bore 28) may prevent long sleeve cartridge 50*a*, 50*b* from moving axially beyond the shoulder 31*a*, 31*b*, and may provide a force on packing seal assembly 80 (e.g., through long sleeve cartridge 50*a*, 50*b*) to energize seals 84, 86, as detailed above.

Spring 88 may provide the desired compression force to energize or otherwise set or pre-load the seals 84, 86 around the plunger 29. Compared to conventional fluid ends, the spring pre-load eliminates the need for inserting a threaded cap in the second bore 28 to pre-load seals 84, 86 thereby reducing the number of components needed within the fluid end block 14, as well as improving control of pre-loading forces. By eliminating the need for a threaded cap in the second bore 28 to pre-load seals 84, 86, the fluid end block 14 and long sleeve cartridge 50*a*, 50*b* arrangement of the present disclosure enables ease of access to the packing seal assembly 80 for replacement through third bore 30, as compared to conventional fluid ends. For example, a user or operator need not access the packing seal assembly 80 through second bore 28 on the mounting surface 20 side of fluid end block 14, and the user or operator may access the packing seal assembly 80 from the free end of the fluid end block 14 (e.g., through third bore 30 on the first block surface 22 side of fluid end block 14).

The spring 88 may also maintain the pre-load force on seals 84, 86 as seals 84, 86 wear, as detailed above, and thus may continually and adequately energize seals 84, 86. Compared to conventional fluid ends, the use of spring 88 may reduce or eliminate common failures of the seals caused by a lack of compression on seals 84, 86 due to the wear. Such an arrangement of the spring 88 may also reduce or eliminate manual human interaction to maintain compression on the seals 84, 86 while pump 10 is operating. For example, use of spring 88 in packing seal assembly 80 may eliminate the need for an operator to manually tighten or otherwise adjust the threaded cap of conventional fluid ends due to spring 88 automatically maintaining the compression force on seals 84, 86. The use of spring 88 may reduce failures commonly caused by incorrect or lack of servicing and normal component wear. Thus, seals 84, 86 may have longer service life compared to conventional fluid ends, and use of spring 88 may decrease catastrophic seal failures.

Compared to conventional fluid ends, the seal grooves 76 of long sleeve cartridge 50*a*, 50*b* and the seal grooves 92, 94 of fluid end block 14, and corresponding seals (e.g., seal 107 and seals 101, 103, respectively) may provide an improved sealing arrangement that reduces and/or prevents fracking fluid from leaking between long sleeve cartridge 50*a*, 50*b* and the interior of fluid end block 14. The first embodiment of the long sleeve cartridge 50*a* and the second embodiment of the long sleeve cartridge 50*b* may provide for various arrangements and provide for load sharing with fluid end block 14. For example, the long sleeve cartridge 50*a* may be configured such that it reduces the load exerted from the fluid pressure onto the fluid end block 14. Accordingly, long sleeve cartridge 50*a*, 50*b* may reduce maintenance time and down time of pump 10, thus reducing overall operating costs of using pump 10.

It will be apparent to those skilled in the art that various modifications and variations can be made to the disclosed long sleeve cartridge and fluid end block without departing from the scope of the disclosure. Other embodiments of the method and system will be apparent to those skilled in the art from consideration of the specification and practice of the systems disclosed herein. It is intended that the specification and examples be considered as exemplary only, with a true scope of the disclosure being indicated by the following claims and their equivalents.

What is claimed is:

1. A fluid end block for a pump, comprising:

a first bore configured to receive fracking fluid from an inlet of the pump;

a second bore configured to receive a reciprocating plunger, wherein the second bore includes a first portion having a first inner diameter and a second portion having a second inner diameter that is smaller than the first inner diameter such that a shoulder is defined between the first portion and the second portion;

a third bore configured to receive a cover;

a fourth bore configured to receive pressurized fluid, wherein the first bore and the fourth bore are substantially perpendicular to the second bore and the third bore;

a long sleeve cartridge having a hollow interior, the long sleeve cartridge being disposed within the third bore and the second bore, the long sleeve cartridge configured to be removable from the fluid end block, wherein a proximal end of the long sleeve cartridge contacts the shoulder of the second bore; and a packing seal assembly disposed within the hollow interior of the long sleeve cartridge, the packing seal assembly having one or more seals.

2. The fluid end block of claim 1, wherein the packing seal assembly contacts the shoulder of the second bore, and the shoulder of the second bore provides a compression force to the one or more seals.

3. The fluid end block of claim 1, wherein the long sleeve cartridge is made of two or more pieces and the packing seal assembly is secured within the long sleeve cartridge axially between the two or more pieces.

4. The fluid end block of claim 3, wherein an interior surface of a first piece of the long sleeve cartridge defines a first shoulder adjacent a proximal end of the first piece, and an interior surface of a second piece of the long sleeve cartridge defines a second shoulder adjacent a proximal end of the second piece, and wherein the packing seal assembly is secured axially between the first shoulder and the second shoulder of the long sleeve cartridge.

5. The fluid end block of claim 1, wherein an interior surface of the long sleeve cartridge defines a shoulder, and a portion of the packing seal assembly contacts the shoulder of the long sleeve cartridge.

6. The fluid end block of claim 1, wherein the packing seal assembly further includes a biasing mechanism configured to provide a compression force on the one or more seals.

7. The fluid end block of claim 6, wherein the biasing mechanism is a spring.

8. The fluid end block of claim 1, wherein an external surface of the long sleeve cartridge is threaded to an internal surface of the fluid end block.

9. A method of replacing a packing seal assembly of a fluid end block, wherein the fluid end block includes a first bore, a second bore including a first portion having a first inner diameter and a second portion having a second inner diameter that is smaller than the first inner diameter such that a shoulder is defined between the first portion and the second portion, a third bore, a fourth bore, wherein the first bore and the fourth bore are substantially perpendicular to the second bore and the third bore, wherein the method comprises:

removing a long sleeve cartridge from the fluid end block through the third bore, the long sleeve cartridge including a packing seal assembly having one or more seals; and inserting a new packing seal assembly through the third bore thereby disposing the new packing seal assembly within the second bore, wherein a proximal end of the long sleeve cartridge contacts the shoulder of the second bore.

10. The method of claim 9, further including:

replacing the packing seal assembly with the new packing assembly within the same long sleeve cartridge.

11. The method of claim 9, further including:

replacing the long sleeve cartridge with a new long sleeve cartridge having the new packing seal assembly.

12. The method of claim 9, further including:

inserting the long sleeve cartridge through the third bore such that a proximal end of the packing seal assembly contacts the shoulder of the second bore, wherein the shoulder of the second bore provides a compression force on the one or more seals.

13. The method of claim 9, wherein the long sleeve cartridge is made of two or more pieces, and the method further includes:

uncoupling the two or more pieces of the long sleeve cartridge;

removing the packing seal assembly from the long sleeve cartridge;

inserting a new packing seal assembly into one piece of the long sleeve cartridge; and coupling the two or more pieces of the long sleeve cartridge together such that the new packing seal assembly is secured within the long sleeve cartridge axially between the two or more pieces.

14. The method of claim 13, wherein an interior surface of a first piece of the long sleeve cartridge defines a first shoulder adjacent a proximal end of the first piece, and an interior surface of a second piece of the long sleeve cartridge defines a second shoulder adjacent a proximal end of the second piece, and the method further includes:

coupling the first piece and the second piece such that the packing seal assembly is secured axially between the first shoulder and the second shoulder.

15. The method of claim 9, wherein the new packing seal assembly further includes a biasing mechanism, and wherein the biasing mechanism provides a compression force on the one or more seals.

16. A long sleeve cartridge for being inserted into a fluid end block of a pump, comprising:

a body extending between a first end and a second end;

a sleeve bore extending through the body from the first end to the second end such that the body defines a hollow interior having a first inner diameter and a second inner diameter, wherein the first inner diameter is less than the second inner diameter;

a first aperture located on a first side of the body, and a second aperture located on the body in a radial position substantially diametrically opposite of the first aperture; and a packing seal assembly configured to be secured within the long sleeve cartridge, the packing seal assembly having one or more seals and a biasing mechanism configured to provide a compression force on the one or more seals, the packing seal assembly arranged within the second inner diameter of the hollow interior when the packing seal assembly is disposed within the long sleeve cartridge.

17. The long sleeve cartridge of claim 16, wherein the long sleeve cartridge is a unitarily formed, one piece structure.

18. The long sleeve cartridge of claim 16, wherein the long sleeve cartridge is made of two or more pieces and the packing seal assembly is secured within the long sleeve cartridge axially between the two or more pieces when the packing seal assembly is disposed within the long sleeve cartridge.

19. The long sleeve cartridge of claim 18, wherein an interior surface of a first piece of the long sleeve cartridge defines a first shoulder adjacent a proximal end of the first piece, and an interior surface of a second piece of the long sleeve cartridge defines a second shoulder adjacent a proximal end of the second piece, and wherein the packing seal assembly is secured axially between the first shoulder and the second shoulder of the long sleeve cartridge when the packing seal assembly is disposed within the long sleeve cartridge.

20. The long sleeve cartridge of claim 16, wherein the body includes an external surface that defines a first outer diameter and a second outer diameter of the body, wherein the first outer diameter is less than the second outer diameter.

* * * * *